US007288054B2

(12) United States Patent
Endelman et al.

(10) Patent No.: US 7,288,054 B2
(45) Date of Patent: Oct. 30, 2007

(54) REFORMER EXERCISE APPARATUS FOOT BAR SUPPORT

(75) Inventors: Ken Endelman, Sacramento, CA (US); Paul R. Hughes, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 366 days.

(21) Appl. No.: 10/933,015

(22) Filed: Sep. 1, 2004

(65) Prior Publication Data

US 2006/0046914 A1 Mar. 2, 2006

(51) Int. Cl.
*A63B 26/00* (2006.01)

(52) U.S. Cl. ..... 482/142; 482/121

(58) Field of Classification Search ..... 482/121, 482/142

See application file for complete search history.

(56) References Cited

U.S. PATENT DOCUMENTS

| | | | | |
|---|---|---|---|---|
| 2,733,922 | A | 2/1956 | Diego | |
| 5,792,033 | A | 8/1998 | Merrithew et al. | |
| 6,120,425 | A * | 9/2000 | Endelman | 482/142 |
| 6,338,704 | B1 * | 1/2002 | Endelman | 482/142 |
| 7,163,500 | B2 * | 1/2007 | Endelman et al. | 482/142 |

OTHER PUBLICATIONS

Stott Pilates—Equipment Advertisement—Professional Reformer, p. 1 of 3 pages.
Stott Pilates—Equipment Advertisement—Rack & Roll Reformer, p. 1 of 3 pages.

* cited by examiner

*Primary Examiner*—Lori Amerson
(74) *Attorney, Agent, or Firm*—Greenberg Traurig LLP; John R. Wahl, Esq.

(57) ABSTRACT

A reformer exercise apparatus has a generally rectangular frame having a head end and a foot end and including a pair of spaced apart parallel track members, a movable carriage mounted on the frame for movement along the track members between said head and foot ends against one or more springs connected between the carriage and the foot end of the frame and an adjustable foot bar assembly mounted at the foot end of the frame. The foot bar assembly includes a foot bar and a foot bar support bar that fits into a pair of support brackets. Each bracket is a generally block shaped body fastened to the foot end of the frame. The bracket has a plurality of vertically spaced, downwardly opening slanted slots therein for receiving the support bar, each slanted slot having an entrance portion extending upward to an enlarged support portion at a base of the slot for retaining the support bar therein. The enlarged support portion forms a pocket to positively retain the support bar. A lock block that removably fastens to the foot bar support bar may be slidably inserted into the support portion of the bracket to lock the support bar in the support portion of the bracket.

21 Claims, 5 Drawing Sheets

REFORMER EXERCISE APPARATUS FOOT BAR SUPPORT

BACKGROUND OF THE INVENTION

1. Field of the Invention

This invention relates generally to the field of exercise equipment in which a movable carriage is utilized to at least partially support a user's body, commonly referred to as a "reformer," and more particularly to a reformer having a foot bar support bracket that passively retains the foot bar support.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U. S. Pat. No. 5,066,005 and my patents referred to above are representative of the current state of evolutionary development of these changes that have taken place since 1927.

The current conventional apparatus is commonly referred to as a "reformer" which includes a wheeled platform carriage which rides on a parallel rails on or forming part of a rectangular wooden or metal frame. The carriage is connected to a series of parallel springs or elastic members which are in turn connected to a foot end of the rectangular frame. The carriage rides on parallel rails or tracks mounted to the inside of the longer sides of the rectangular frame. This carriage typically includes a pair of spaced, padded, upright shoulder stops and a head rest at one end to support the shoulders and head of the user when he/she is reclined on the carriage. An adjustable foot bar, foot support, or foot rest against which the user places his/her feet is mounted to the foot end of the rectangular frame. The user can then push against the foot rest to move the carriage along the track away from the foot rest against spring tension to exercise the leg and foot muscle groups in accordance with prescribed movement routines.

Most conventional reformers utilize a generally U shaped foot bar that has a straight foot support portion between a pair of parallel legs that pivot about a pair of pins each fastened to one of the side rails of the frame of the reformer near the foot end. The foot bar is supported by another U shaped foot bar support that has its free ends pivotally attached to the legs of the foot bar. A mid portion of the foot bar support selectively fits within an upwardly open slot in a bracket mounted on the tracks at the foot end of the frame. This is a simple design. However, if the user of the reformer does not want the foot bar repositioned, yet rotates the foot bar toward the head end of the frame, the foot bar can lift out of the desired slot and must be repositioned again. It is desirable that such movement be minimized or eliminated, to avoid the annoyance of having to readjust the foot bar position. Therefore there is a need for a secure foot bar support bracket configuration that precludes inadvertent removal of the foot bar support upon rotation of the foot bar toward the head end of the reformer.

SUMMARY OF THE INVENTION

Embodiments of the present invention provide a simple, positive retention configuration for a foot bar support in a reformer exercise apparatus. The foot bar support bar is positively retained in the foot bar support bracket unless intentionally removed by the user from the support bracket for repositioning. One embodiment of the present invention may be viewed as the foot bar support bracket for use in a reformer exercise apparatus. Another embodiment may be viewed as a reformer exercise apparatus that has a foot bar support bracket, or more preferably, a pair of foot bar support brackets fastened to the foot end of the reformer frame.

The support bracket in each of these embodiments is preferably a generally rectangular block body that has one side fastened to a vertical surface of the foot end of the frame of the reformer. The support bracket receives a mid portion of a U shaped foot bar support bar in one of several downwardly slanted open slots formed through the opposite side of the block body. Each of the slots has an open entry portion and an enlarged retention and support portion. The open entry portion has parallel top and bottom walls slanted upward from the opening into the support portion. The support portion has a shape generally complementary to the cross sectional shape of the foot bar support bar and a distance between the top wall and the bottom wall of the slot greater than the width of the mid portion of the foot bar support. Preferably the support portion has a width between the top and bottom walls at least about 1.5 times the width of the entry portion of the slot. Further, the top wall of the slot is smooth and almost straight from the opening to the base of the slot. Preferably the top wall of the slot has a slight upward curve. In contrast, the bottom wall is generally parallel to the top wall in the entry portion and has a transition between the entry portion and the support portion such that the support portion forms a pocket to receive the mid portion of the foot bar support bar therein.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
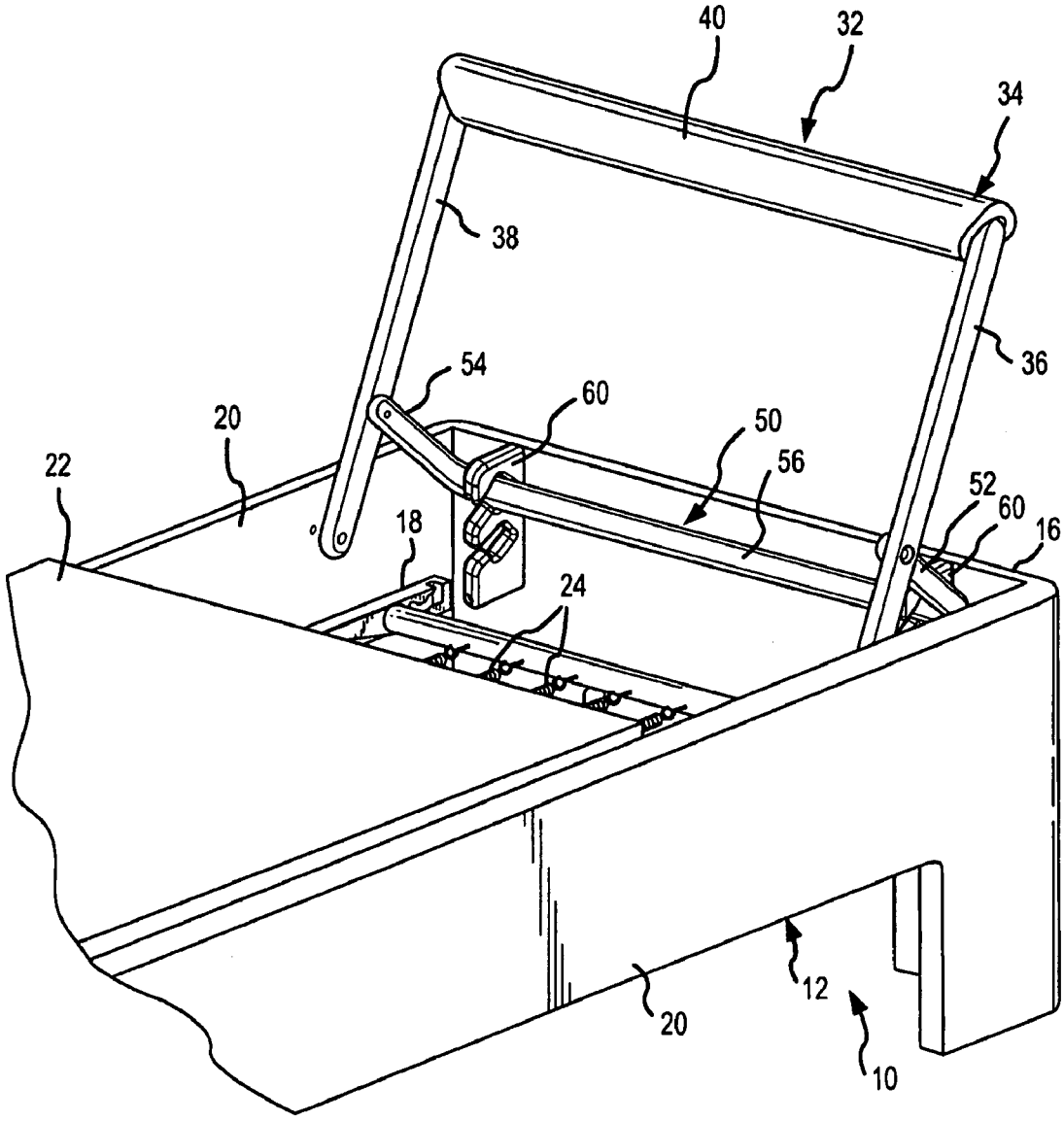
FIG. 1 is a perspective view of the foot end of a reformer exercise apparatus incorporating a foot bar support bracket in accordance with one embodiment of the present invention.

An exercise apparatus 10 in accordance with one embodiment of the present invention is shown in FIG. 1. Exercise apparatus 10 comprises a generally rectangular frame 12 having a head end and a foot end 16 and a pair of parallel track or rail members 18. The frame 12 typically is a generally rectangular wood frame with the track or rail members 18 fastened to the insides of opposite side walls 20 of the frame 12. The apparatus 10 further comprises a movable carriage 22 slidably or rollably disposed on the track members 18 for movement back and forth on the track members 18 between the head and foot ends respectively.

Preferably the carriage 22 has four support wheels or rollers (not shown), which support the carriage 22 on the horizontal top surfaces of the track members 18 for movement back and forth on the track members 18 with minimal friction. A plurality of elastic resistance members, typically coil springs 24, are hooked to or otherwise fastened to an anchor bar 26 and extending between the foot end of the carriage 22 and the anchor bar 26 near the foot end 16 of the frame 12 such that the carriage 22 is biased toward the foot end 16 of the frame 12.

The foot bar assembly 32 includes a generally U shaped foot bar 34, preferably made of tubular aluminum, having a pair of spaced parallel legs 36 and 38 and a padded foot bar portion 40 therebetween. The free end of each of the legs 36 and 38 are pivotally fastened to the frame 12 near the foot end 16. A generally U shaped foot bar support bar 50 has its legs 52 and 54 each pivotally fastened to the legs 36 and 38. This support bar 50 is used to position the padded foot bar portion 40 of the foot bar 34 at predetermined heights. A mid portion 56 of the support bar 50 removably fits within slots in the brackets 60 in accordance with the present invention. The vertical position of the foot bar portion 40 of the foot bar 34 in relation to the frame 12 may be changed depending on the position of the foot bar support bar 50 in the support brackets 60. As shown in FIG. 1, the foot bar 34 is in an upper position. If the support bar 50 were moved to the lower set of slots in the brackets 60, the foot bar 34 would be in a lower position with respect to the frame 12.

Figure 2:
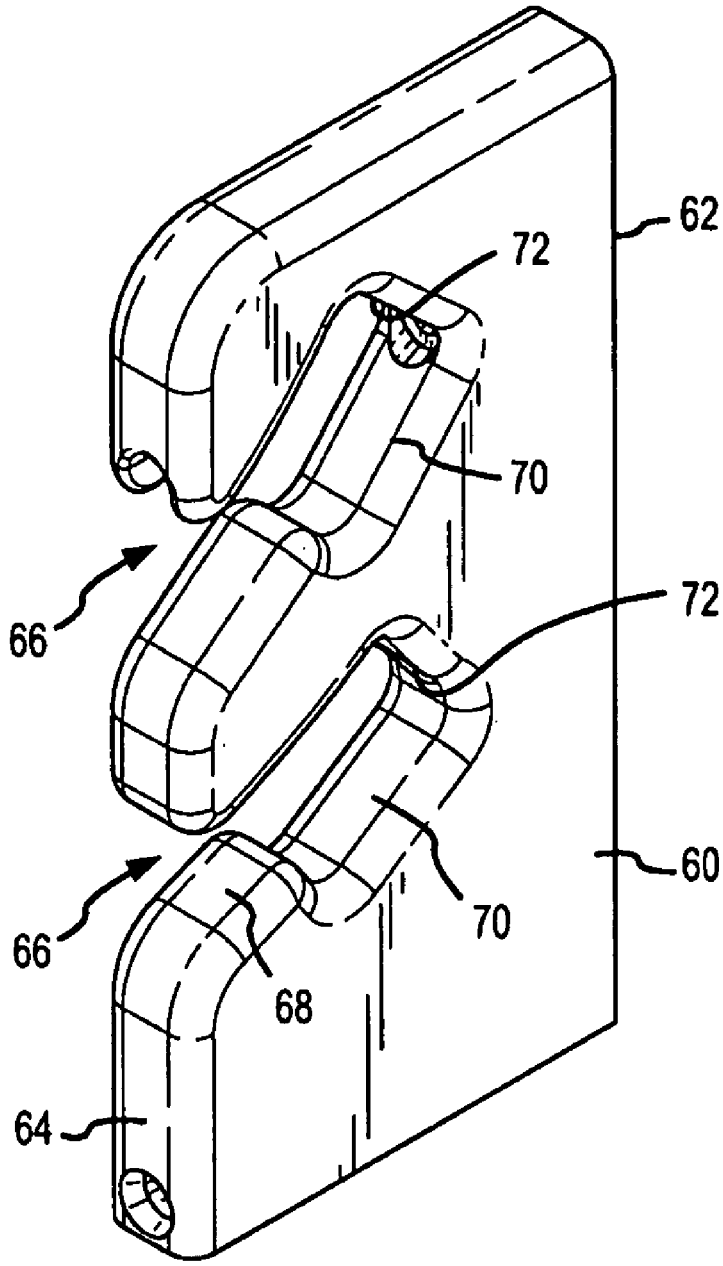
FIG. 2 is a separate perspective view of the foot bar support bracket in accordance with the present invention shown in FIG. 1.

A separate perspective view of one of the support brackets 60 is shown in FIG. 2. Each of the support brackets is preferably a generally rectangular block body preferably made of a plastic material. Alternatively, the bracket 60 may be made of sheet metal or other substantially rigid material. The bracket 60 has a straight side 62 and an opposite side 64. The straight side 62 is preferably flat and straight, adapted to be fastened to the foot end 16 of the reformer exercise apparatus 10. The opposite side 64 of the block body has a plurality of downwardly opening slanted slots 66 cut through the opposite side 64, each slot 66 having an entrance portion 68 slanted upward to a support portion 70 at a base 72 of the slot 66 for retaining the mid portion 56 of the foot bar support bar 50.

Figure 3:
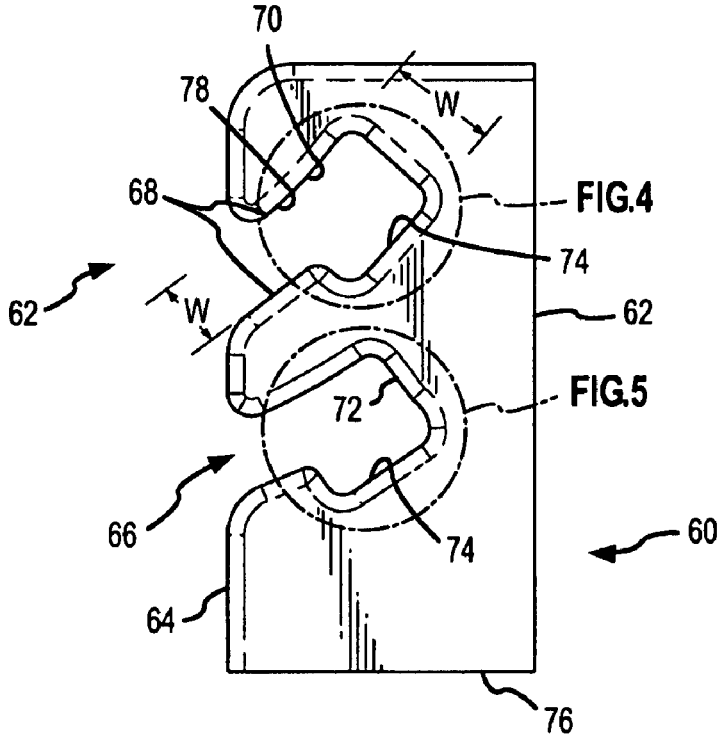
FIG. 3 is a separate side view of the foot bar support bracket shown in FIGS. 1 and 2.

A side view of the bracket 60 shown in FIG. 2 is shown in FIG. 3. Each support portion 70 of the slot has a width "W" greater than a cross sectional width "w" of the entrance portion 68, and thus forms a pocket 74 for receiving and holding the mid portion of the foot bar support bar 50. The brackets 60 are designed to be fastened via bolts or other fasteners to the foot end 16 of the frame 12, thus positioning them a predetermined distance from the pivot point of the legs 36 and 38 of the foot bar 40.

The slanted slots 66 each have central axes that differ in angle to the opposite side 64. This is because the distance between the brackets 60 and the pivot points of the support bar 50 rotate with arcuate position of the foot bar 34. The central axis of each slot 66 is designed to follow an arc of rotation of the support bar 50 when the foot bar 34 is at a position above the frame 12 corresponding approximately to each slot's support portion 74. Thus, each slanted slot is also at a different angle with respect to the bottom, horizontal side 76, of the bracket 60.

The top wall 78 of the slot 66 is a generally smooth surface which is slightly curved so as to follow the swing arc of the mid portion 56 of the support bar 50 as the bar 50 is rotated along the slot 66. Since the support portion 70 of the slot 66 has a width W that is greater than the width w of the entrance portion 68, there is a transition 80 in the bottom wall of the slot 66 between the entrance portion 68 and the support portion 70. This transition 80 is preferably a rounded corner that leads into the pocket 74 of the support portion 70.

Figure 4:
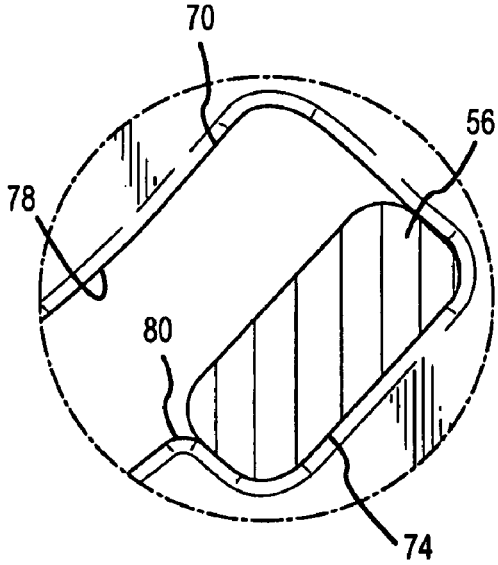
FIG. 4 is an enlarged partial side view of the upper slot in the bracket shown in FIG. 3.
Figure 5:
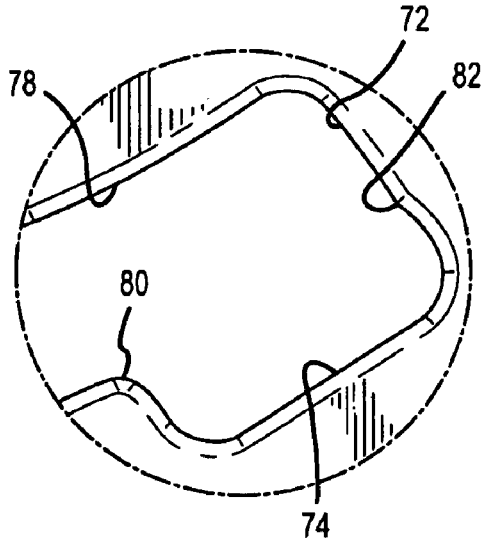
FIG. 5 is an enlarged partial side view of the lower slot in the bracket shown in FIGS. 1-3.

The support portion 70 also preferably has a slight protrusion 82 in the base of the slot 66 that pinches the mid portion 56 of the support bar 50 when it is properly seated in the pocket 74 of the support portion 70. This protrusion 82 may be a transverse ridge across the base 72 or may simply be a raised nub formed in the base 72. This protrusion provides a tactile feedback to a user to indicate when the support bar 50 is properly secured in the slot 66 as is shown in FIG. 4.

The top to bottom width of the support portion 70, i.e. width "W", is preferably at least 1.5 times the width "w" of the entrance portion 68 of the slot. This distance is chosen so that the bar 50 will naturally remain within the support portion of the slot 66. Although the support bar 50 is shown having a rounded rectangular cross sectional shape in FIGS. 1 and 4, the support bar 50 could have a different cross section shape, such as square or circular.

In use, if a user wishes to change the position of the foot bar 34, she simply lifts up on the mid portion 40 of the bar 34 to disengage the support bar 50 from the pocket 74. The support bar 50 will then hit the top wall 78 of the slot 66 and the bar 34 cannot be raised further. The user then lowers the bar 34 slightly, and the support bar 50 will swing downward, out of the slot 66. The user can then reposition the support bar 50 into an alternative slot 66. Although the support bar 50 may be easily removed, movement of the foot bar 34 toward the carriage 22 is substantially minimized by the present invention. The foot bar 34 may only be moved about half the width W before being stopped by the top wall 78 of the slot 66.

Figure 6:
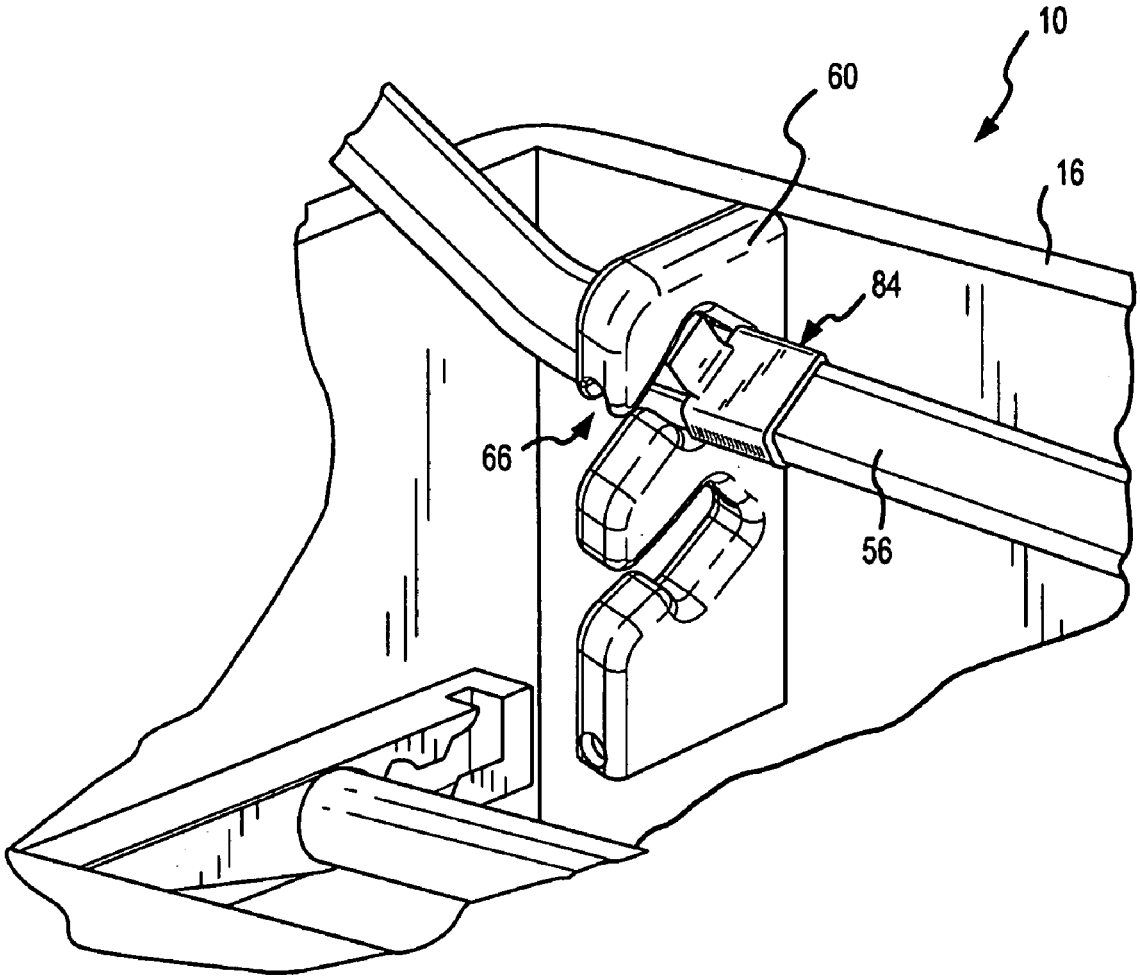
FIG. 6 is an enlarged partial perspective view of the foot bar support bracket shown in FIG. 1 in which a slidable stop block in accordance with another aspect of the present invention is installed on the support bar.
Figure 7:
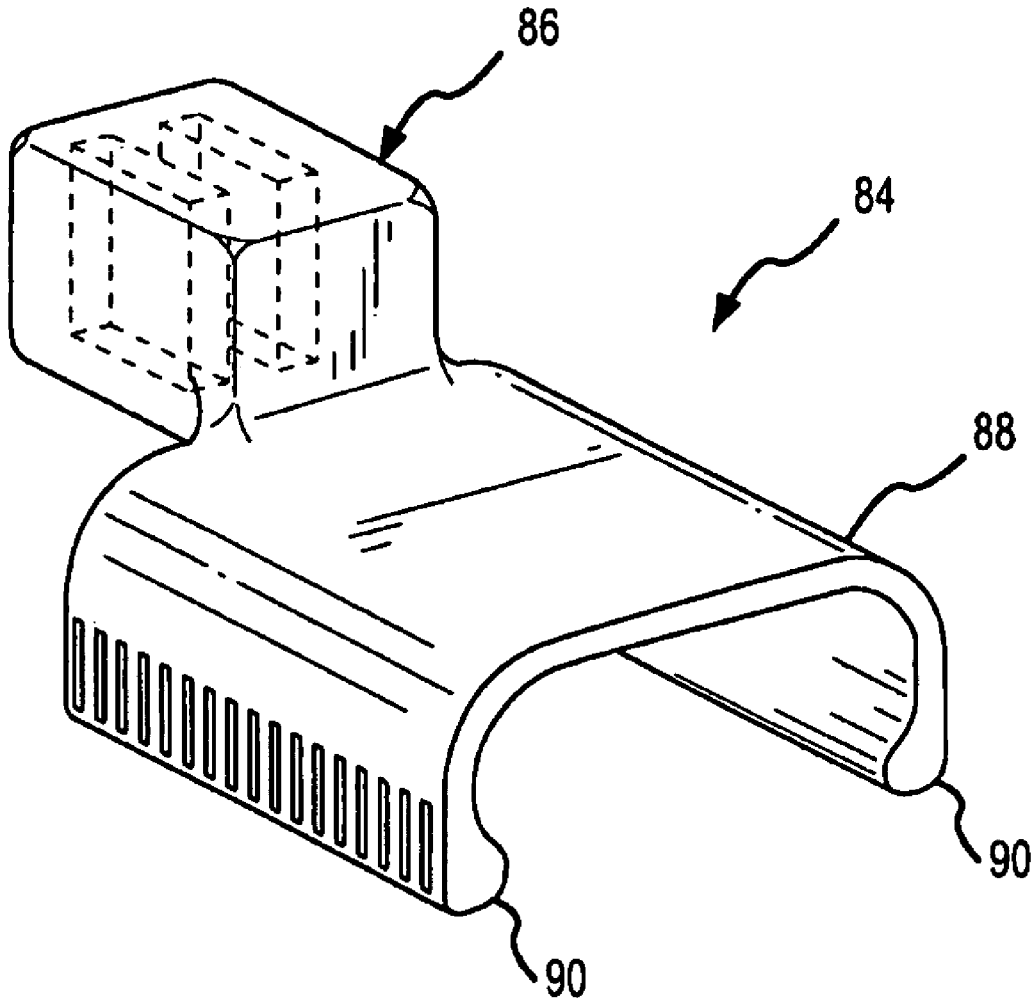
FIG. 7 is a separate perspective view of the slidable stop block shown in FIG. 6.

One or a pair of optional lock blocks 84 may also be installed on the mid portion 56 of the support bar 50 to prevent all movement of the foot bar 34 during certain exercises. One lock block 84 is shown in the partial view of the reformer 10 shown in FIG. 6. This lock block 84 has a block portion 86 which fits into the support portion 70 of the slot 66 over the mid portion 56 in the pocket 74 in the support block 60. Joining the block portion 86 is an integral slide portion 88. The block portion 86 is preferably a rectangular plastic block having a height slightly less than the distance between the top of the mid portion 56 and the top wall 78 of the slot 66 such that the lock block 84 can easily be slipped into the slot 66 when the mid portion 56 of the support bar 50 is seated in the pocket 74. The slide portion 88 is a "C" shaped sleeve that has opposing enlarged end edges 90 that resiliently snap over and grip the curved sides of the mid portion 56 of the bar 50 to preferably removably fasten, i.e. grip and retain the lock block 84 on the mid portion 56 while permitting a user to slide the lock block 84 back and forth.

The C shape of the slide portion 88 permits the lock block 84 to be removed should a user prefer not to use them. When the lock blocks 84 are installed on the mid portion 56 with the block portions 86 inserted within the slots 66, substantially all movement of the bar 50 within the support blocks 60 is eliminated. Preferably a pair of lock blocks 84 are installed onto the mid portion 56 of the bar 50, with one adjacent each block 60. The user can then conveniently insert or remove the block portions 86 from the slots 66 as needed without removing the lock blocks 84 from the bar 50.

The lock block 84 is preferably made of a flexible polymeric material such as a high density polyethylene that has the strength and resiliency coupled with rigidity to both snap onto the mid portion of the support bar 50 and prevent substantial movement of the bar 50 when the lock portion 86 of the lock block 84 is inserted into the support portion of the slots 66. The support block 60 is preferably made of or rigid polymeric material that has sufficient strength, rigidity, and durability for the support functionality. One such material is The Polymer Corporation's Nylatron® GS, which is a nylon 6 material having a molybdenum disulfide filler.

Although the embodiment 60 shown in FIGS. 1-6 has only two slots 66, other configurations, having 3, 4 or 5 slots 66 are envisioned. Also, the bracket 60 may have other than a rectangular block shape. The bracket 60 and the lock block 84 may alternatively be made of wood or a sheet metal material such as aluminum or other suitable material. However, a moldable plastic material is preferred. Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. A foot bar support bar support comprising:

a generally block body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar.

2. A foot bar support bar support comprising:

a body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein each slanted slot is at a different angle with respect to the opposite side.

3. A foot bar support bar support comprising:

a body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein the pocket has at least one protrusion for retaining the mid portion of a foot bar support bar inserted into the pocket.

4. A foot bar support bar support comprising:

a block body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein a width of the support portion is at least 1.5 times the width of the entrance portion of the slot.

5. A foot bar support bar support comprising:

a generally rectangular block body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein a top wall of each slanted slot has a substantially smooth common surface extending between the entrance and support portions.

6. A foot bar support bar support comprising:

a generally rectangular block body having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein a bottom wall of each slanted slot has an angled transition between the entrance portion and the support portion.

7. A foot bar support bar support comprising:

a body having a generally straight side and an opposite side, the straight side being adapted to be fastened to a foot end of a reformer exercise apparatus, the opposite side having a plurality of slanted slots downwardly opening through the opposite side, each slot having an entrance portion leading upward to a support portion at a base of the slot for retaining a mid portion of a foot bar support bar therein, each support portion of the slot having a width greater than a cross sectional width of the entrance portion forming a pocket for receiving and holding the mid portion of the foot bar support bar wherein a bottom wall of each slanted slot has a curved corner angled transition between the entrance portion and the support.

8. A foot bar support bar support comprising:

a body made of a polymer having a straight side and an opposite side, the straight side being adapted to be fastened to a foot end of a reformer exercise apparatus, the opposite side having a plurality of slanted slots downwardly opening through the opposite side, each slot having an entrance portion leading upward into a support portion at a base of the slot for retaining a mid portion of a foot bar support bar therein, each support portion of the slot having a width greater than a cross sectional width of the entrance portion forming a pocket for receiving and holding the mid portion of the foot bar support bar.

9. An exercise apparatus comprising:

a generally rectangular frame having a head end and a foot end and including a pair of spaced apart parallel track members between the ends, supporting a movable carriage for movement along said track members;

one or more elongated elastic members extending between the carriage and the foot end of said frame;

a generally U shaped foot bar pivotally supported from the frame near the foot end having a U shaped foot bar support bar pivotally supported from legs of the foot bar, wherein the foot bar support bar has a mid portion; and a foot bar support bar support bracket fastened to the foot end of the frame, the bracket having a plurality of vertically spaced, downwardly opening slanted slots therein for receiving the mid portion of the support bar, each slanted slot having an entrance portion extending upward to a support portion of the slot for retaining the mid portion of the support bar therein.

10. An exercise apparatus comprising:

a generally rectangular frame having a head end and a foot end and including a pair of spaced apart parallel track members between the ends, supporting a movable carriage for movement along said track members;

one or more elongated elastic members extending between said carriage and the foot end of said frame;

a generally U shaped foot bar pivotally supported from the frame near the foot end having a U shaped foot bar support bar pivotally supported from legs of the foot bar, wherein the foot bar support bar has a mid portion; and a pair of generally block shaped foot bar support bar support brackets fastened to the foot end of the frame, each bracket having a plurality of vertically spaced, downwardly opening slanted slots therein for receiving the mid portion of the support bar, each slanted slot having an entrance portion extending upward to a support portion at a base of the slot for retaining the mid portion of the support bar.

11. An exercise apparatus comprising:

a generally rectangular frame having a head end and a foot end and including a pair of spaced apart parallel track members between the ends, supporting a movable carriage for movement along said track members;

one or more elongated elastic members extending between said carriage and the foot end of said frame;

a generally U shaped foot bar pivotally supported from the frame near the foot end having a U shaped foot bar support bar pivotally supported from legs of the foot bar, wherein the foot bar support bar has a mid portion; and a generally block shaped foot bar support bar support bracket fastened to the foot end of the frame, the bracket having a plurality of vertically spaced, downwardly opening slanted slots therein for receiving the mid portion of the support bar, each slanted slot having an entrance portion extending upward to a support portion of the slot for retaining the mid portion of the support bar therein wherein the support portion forms a pocket frictionally retaining the mid portion of the foot bar support bar inserted into the pocket.

12. An exercise apparatus comprising:

a generally rectangular frame having a head end and a foot end;

one or more elongated elastic members extendable between a movable carriage mounted for movement along the frame between the ends and the foot end of the frame;

a generally U shaped foot bar pivotally supported from the frame near the foot end having a U shaped foot bar support bar pivotally supported from legs of the foot bar, wherein the foot bar support bar has a mid portion; and a generally block shaped foot bar support bar support bracket fastened to the foot end of the frame, the bracket having a plurality of vertically spaced, downwardly opening slanted slots therein for receiving the mid portion of the support bar, each slanted slot having an entrance portion extending upward to a support portion of the slot for retaining the mid portion of the support bar inserted therein wherein a width of the support portion is at least 1.5 times the width of the entrance portion of the slot.

13. An exercise apparatus comprising:

a generally rectangular frame having a head end and a foot end and including a pair of spaced apart parallel track members between the ends, supporting a movable carriage for movement along said track members;

one or more elongated elastic members extendable between said carriage and the foot end of said frame;

a generally U shaped foot bar pivotally supported from the frame near the foot end having a U shaped foot bar support bar pivotally supported from legs of the foot bar, wherein the foot bar support bar has a mid portion; and a foot bar support bar support bracket fastened to the foot end of the frame, the bracket having a plurality of vertically spaced, downwardly opening slanted slots therein for receiving the mid portion of the support bar, each slanted slot having an entrance portion extending upward to a support portion for retaining the mid portion of the support bar inserted in the slot wherein a top wall of each slanted slot has a substantially smooth common surface extending between the entrance and support portions.

14. An exercise apparatus comprising:

a generally rectangular frame having a head end and a foot end and including a pair of spaced apart parallel track members between the ends, supporting a movable carriage for movement along said track members;

a plurality of elongated elastic members extending between said carriage and the foot end of said frame;

a generally U shaped foot bar pivotally supported from the frame near the foot end having a U shaped foot bar support bar pivotally supported from legs of the foot bar, wherein the foot bar support bar has a mid portion; and a foot bar support bar support bracket fastened to the foot end of the frame, the bracket having a plurality of vertically spaced, downwardly opening slanted slots therein for receiving the mid portion of the support bar, each slanted slot having an entrance portion extending upward to a support portion at a base of the slot for retaining the mid portion of the support bar therein wherein a top wall of each slanted slot has a substantially smooth common surface extending between the entrance and support portions and a bottom wall of each slanted slot has an angled transition between the entrance portion and the support portion.

15. An exercise apparatus comprising:

a generally rectangular frame having a head end and a foot end and including a pair of spaced apart parallel track members between the ends, supporting a movable carriage for movement along said track members;

one or more elongated elastic members extending between said carriage and the foot end of said frame;

a generally U shaped foot bar pivotally supported from the frame near the foot end having a U shaped foot bar support bar pivotally supported from legs of the foot bar, wherein the foot bar support bar has a mid portion; and a foot bar support bar support bracket fastened to the foot end of the frame, the bracket having a plurality of vertically spaced, downwardly opening slanted slots therein for receiving the mid portion of the support bar, each slanted slot having an entrance portion extending upward from a side of the bracket facing the carriage to an expanded support portion at a base of the slot for retaining the mid portion of the support bar therein, wherein a top wall of each slanted slot has a substantially smooth common surface extending between the entrance and support portions and a bottom wall having a curved corner transition between the entrance portion and the support portion.

16. An exercise apparatus comprising:

a generally rectangular frame having a head end and a foot end and including a pair of spaced apart parallel track members between the ends;

a movable carriage mounted on said frame for movement along said track members;

one or more elongated elastic members extending between said carriage and fastenable to an anchor bar fastened near said foot end of said frame;

an adjustable foot bar pivotably mounted to said frame spaced from the foot end; and a foot bar support bracket fastened to the foot end of the frame, the bracket having one side abutting the foot end of the frame and an opposite side facing the carriage, the foot bar support bracket having a plurality of downwardly slanted slots opening through the opposite side facing the carriage, each of the slots extending from an entrance portion upward into a support portion spaced from the opposite side, wherein each slot is sized to receive a mid portion of a foot bar support bar and hold the mid portion in the support portion.

17. An exercise apparatus comprising:

a generally rectangular frame having a head end and a foot end and including a pair of spaced apart parallel track members between the ends;

a movable carriage mounted on said frame for movement along the track members;

one or more elongated elastic members extending between said carriage and fastenable to an anchor bar fastened near said foot end of said frame;

an adjustable foot bar pivotably mounted to said frame spaced from the foot end; and a foot bar support bracket fastened to the foot end of the frame, the bracket having a generally rectangular block shape with one side abutting the foot end of the frame and an opposite side facing the carriage, the foot bar support bracket having a plurality of downwardly slanted slots opening through the opposite side facing the carriage, each of the slots extending from an entrance portion upward into a support portion spaced from the opposite side, wherein each slot is sized to receive a mid portion of a foot bar support bar and hold the mid portion in the support portion, the support portion forming a pocket retaining the mid portion of the foot bar support bar inserted into the pocket.

18. An exercise apparatus comprising:

a generally rectangular frame having a head end and a foot end and including a pair of spaced apart parallel track members between the ends;

a movable carriage mounted on said frame for movement along said track members;

one or more elongated elastic members extending between said carriage and an anchor bar fastened near said foot end of said frame;

an adjustable foot bar pivotably mounted to said frame spaced from the foot end; and a foot bar support bracket fastened to the foot end of the frame, the bracket having a generally rectangular block shape with one side abutting the foot end of the frame and an opposite side facing the carriage, the foot bar support bracket having a plurality of downwardly slanted slots opening through the opposite side facing the carriage, each of the slots extending from an entrance portion upward into a support portion spaced from the opposite side, wherein each slot is sized to receive a mid portion of a foot bar support bar and hold the mid portion in the support portion wherein a width of the support portion is at least 1.5 times a width of the entrance portion of the slot.

19. An exercise apparatus comprising:

a generally rectangular frame having a head end and a foot end and including a pair of spaced apart parallel track members between the ends;

a movable carriage mounted on said frame for movement along said track members;

one or more elongated elastic members extending between said carriage and an anchor bar fastened near said foot end of said frame;

an adjustable foot bar pivotably mounted to said frame spaced from the foot end; and a foot bar support bracket fastened to the foot end of the frame, the bracket having a generally rectangular block shape with one side abutting the foot end of the frame and an opposite side facing the carriage, the foot bar support bracket having a plurality of downwardly slanted slots opening through the opposite side facing the carriage, each of the slots extending from an entrance portion upward into a support portion spaced from the opposite side, wherein each slot is sized to receive a mid portion of a foot bar support bar and hold the mid portion in the support portion wherein a top wall of each slanted slot has a substantially smooth common surface extending between the entrance and support portions.

20. An exercise apparatus comprising:

a generally rectangular frame having a head end and a foot end and including a pair of spaced apart parallel track members between the ends;

a movable carriage mounted on said frame for movement along said track members;

one or more elongated elastic members extending between the carriage and an anchor bar fastened near said foot end of said frame;

an adjustable foot bar pivotably mounted to said frame spaced from the foot end;

a foot bar support bracket fastened to the foot end of the frame, the bracket having a generally rectangular block shape with one side abutting the foot end of the frame and an opposite side facing the carriage, the foot bar support bracket having a plurality of slanted slots each downwardly opening through the opposite side facing the carriage, each of the slots having an upwardly extending entrance portion angling into a support portion spaced from the opposite side, wherein each slot is sized to receive a mid portion of a foot bar support bar and hold the mid portion in the support portion; and a lock block slidably disposed on the foot bar support bar having a portion sized to fit into the support portion of one of the slots to lock the mid portion of the foot bar support bar in the support portion of the slot in the support bracket.

21. A lock block for use in a reformer exercise apparatus having a rectangular frame and a movable carriage mounted to the frame for movement between a head end and a foot end of the frame, a U shaped foot bar pivotally mounted near the foot end of the frame, a U shaped foot bar support bar pivotally fastened to the U shaped foot bar, and a foot bar support bracket fastened to the foot end of the frame for receiving the U shaped foot bar support bar therein, the lock block comprising:

a unitary body having a block portion and a slide portion adapted to ride on a mid portion of the U shaped foot bar support bar, wherein the block portion has a generally rectangular block shape sized to fit into the foot bar support bracket to prevent removal of the U shaped foot bar from the support bracket when the U shaped foot bar is in the support bracket.

* * * * *